United States Patent [19]

Russo et al.

[11] 4,397,220

[45] Aug. 9, 1983

[54] AIR CUSHION FOR PNEUMATIC IMPACT TOOL

[75] Inventors: Mario A. Russo, Edison; Edward I. Auerbach, Belle Mead, both of N.J.

[73] Assignee: Ingersoll-Rand Company, Woodcliff Lake, N.J.

[21] Appl. No.: 260,019

[22] Filed: May 4, 1981

[51] Int. Cl.[3] ..... F15B 15/22; F01B 11/02

[52] U.S. Cl. ..... 91/408; 92/85 B; 92/129; 92/167

[58] Field of Search ..... 91/25, 394, 408, 409, 91/410; 92/84, 85 B, 129, 143, 167

[56] References Cited

U.S. PATENT DOCUMENTS

| | | | |
|---|---|---|---|
| 632,262 | 9/1899 | Gunnell | 91/25 |
| 2,960,068 | 11/1960 | Becker | 91/394 |
| 3,668,975 | 6/1972 | Nelson | 91/409 |

FOREIGN PATENT DOCUMENTS

| | | | |
|---|---|---|---|
| 2414132 | 8/1979 | France | 91/394 |

OTHER PUBLICATIONS

*Automative Industries,* Apr. 15, 1957, p. 169, "Tomkins-Johnson Co. Advertisement".

*Hydraulics and Pnematics,* Apr. 1981, p. 23, "Parker Fluidpower Advertisement".

*Primary Examiner*—Martin P. Schwadron

*Assistant Examiner*—Richard S. Meyer

*Attorney, Agent, or Firm*—Walter C. Vliet

[57] ABSTRACT

The invention disclosed comprises an air cushion system that utilizes a two-diameter piston and a floating bushing to create an effective air cushion seal which prevents the piston from hitting the barrel bridge.

1 Claim, 1 Drawing Figure

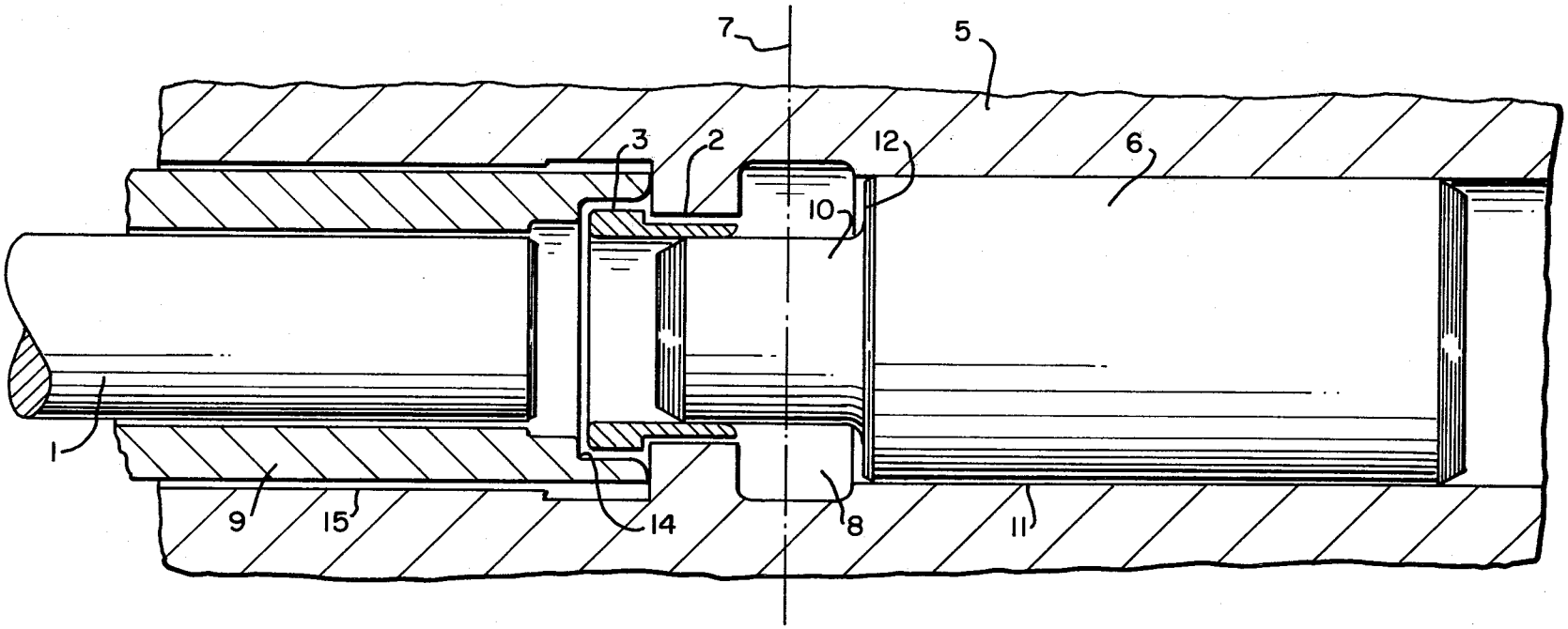
5
6
12
10
7
2
3
11
8
14
15
9
1

AIR CUSHION FOR PNEUMATIC IMPACT TOOL

BACKGROUND OF THE INVENTION

Pneumatic impact mechanisms typically employ a reciprocating piston which is accelerated in one direction by means of alternately applied air pressure. The piston, upon striking its intended anvil (usually a chisel or the like), rebounds in the opposite direction and the process is repeated. Typically in pneumatic tools a bridge or stop is incorporated in the tool barrel to ensure that the piston will not be propelled out of the tool accidentally in the event the chisel is removed. In addition, when the tool is operated in the play-off mode with a long travel retainer (for example, when a typical pneumatic impact tool, such as a chipper) is removed from the work, the chisel moves forward allowing the piston to travel past the design strike point and to hit the retaining bridge.

Repeated hitting of the bridge creates high vibration levels and leads to eventual tool failure. To prevent the piston from striking the bridge, it is common to utilize an air cushion which is formed when the forward motion of the piston takes it past the strike point. The piston is stopped gradually in this manner without hitting the bridge.

Air cushions have been used on light duty pneumatic tools, such as scalers, and in heavy duty tools, such as rock drills. The formation of a successful air cushion requires tight fits between the piston diameters and the barrel bores and tight concentricity tolerances on barrel bores. These tight tolerances are difficult to hold, expensive to produce, and increase the rejection rate.

The present invention allows the use of conventional barrels with little modification and provides the required sealing for an effective air cushion.

It is an object of this invention to provide an air cushion seal which is self-aligning, inexpensive to manufacture, and effective without the need for tight concentricity sealing tolerances.

These and other objects are obtained in an air cushion seal for pneumatic impact tools having a reciprocating piston with a cushion end disposed in a barrel cylinder having a bridge for retaining the piston at one end comprising: a seal bushing disposed in close fitting concentric relationship with the cushion end of the piston when the piston approaches the bridge; the seal bushing being further disposed in concentric relationship with the barrel cylinder at the bridge and having minimum but appreciable radial clearance so as to allow the seal bushing to align itself with the cushion end of the piston while providing a substantially restricted diametral flow path of substantially increased length passed the bridge.

BRIEF DESCRIPTION OF THE DRAWINGS

The FIGURE shows a cross section of a portion of a pneumatic chipper showing the air cushion construction according to this invention.

DESCRIPTION OF THE INVENTION

The FIGURE shows the end portion of a typical pneumatic chipper. A generally cylindrical barrel 5 encloses a cylinder 11, which houses a reciprocating cylindrical piston 6. The piston 6 is formed with a reduced diameter portion 10 towards its one end. The reduced diameter portion 10 forms a land 12 which coacts with a bridge 2 formed in the barrel to prevent the piston from being accidentally propelled from the tool towards its one end or to the left as viewed in the FIGURE.

Also shown inserted in an axially aligned, but separate, bore 15 in the barrel is a cylindrical guide bushing 9. Shown inserted in the guide bushing 9 is a chisel 1. Only the back end of the chisel is shown. The retainer and chisel point construction are conventional and are not a consideration in the present invention. A floating seal bushing 3 is provided to form a seal between the reduced diameter portion of piston 10, the bridge 2, and a counterbored end portion 14 of the guide bushing 9. The floating seal bushing is the core of the present invention.

As previously described, it is important for tool life and noise reduction to prevent the land 12 of the piston 6 from striking the bridge 2. In normal operation, the chisel 1 would be inserted to the design strike point line, designated by the reference numeral 7, and the piston 6 would impact on the chisel producing the desired results. In this case an air cushion is not formed or desirable. However when the chisel is partially removed; for example, to the play-off position as shown in the FIGURE, the piston can travel far enough forward to have land 12 strike the bridge thereby producing noise, vibration, and possibly damage to the tool.

To prevent this, a trapped annular air volume 8 is formed in the reduced diameter portion area of the piston between the piston land 12, the reduced diameter of the piston, the barrel and the bridge. It can be appreciated by one skilled in the art that as the piston 6 moves to the left as shown in FIG. 1, the volume of air trapped in the annular air volume 8 is reduced, and if properly sealed, the pressure in the air volume 8 will increase to stop the piston travel.

It will also be appreciated by one skilled in the art that the degree of sealing depends on the tolerance maintained between the outside diameter of the piston 6 and the inside diameter of the cylinder bore 11. The degree of sealing is also dependent on the seal developed between the reduced diameter portion 10 of the piston and the bridge.

The difficulty of maintaining concentric tolerances has been overcome by the use of the floating seal bushing 3 according to the present invention. Because of the self-aligning feature of the floating seal bushing 3, tight tolerances may be maintained between the reduced diameter portion 10 of the piston and the inside diameter of the floating seal bushing 3. The outside diameter of the floating seal bushing forms a labyrinth-type seal between the bushing and the bridge and guide bushing.

In addition, as the air pressure increases in the trapped annular air volume 8, the floating seal bushing 3 will be forced to the left as shown in the FIGURE by the differential air pressure. This will force the floating seal bushing 3 to seat against the bottom of counter bore 14, thus further increasing the seal effectiveness. The leakage around the outside of the guide bushing 9 may be kept to a minimum by use of a close tolerance fit or other suitable seal.

In the above-described embodiment, all of the components are cylindrical or circular in cross section to facilitate manufacture. They, of course, could be square or other shape without departing from the spirit of the invention. The seal bushing may be contructed of steel, bronze, plastic, or similar materials. These and other modifications will occur to one skilled in the art.

We do not wish to be limited in the scope of our invention except as claimed in the following claims.

We claim:

1. An improved air cushion seal for pneumatic impact tools having a reciprocating free piston with a cushion end disposed in a barrel cylinder having a bridge for retaining the piston at one end comprising:

a seal bushing having an outside diameter of nonuniform diameter to effect a labyrinth seal disposed in close fitting concentric relationship with said cushion end of said piston when said piston approaches said bridge;

said seal bushing being further disposed in concentric relationship with said barrel cylinder at said bridge and having minimum but appreciable radial clearance between its outer diameter and said bridge so as to allow said seal bushing to concentrically align itself with said cushion end of said piston while providing a labyrinth seal of substantially restricted flow path along the outside diameter of said seal bushing and of substantially increased length passed said bridge; and a guide bushing located within said barrel cylinder opposite a portion of said bridge which retains the piston, said guide bushing being counterbored to retain said seal bushing and to form a coacting face seal for said seal bushing.

* * * * *